United States Patent [19]

Kalippke et al.

[11] Patent Number: 4,913,114

[45] Date of Patent: Apr. 3, 1990

[54] GOVERNING APPARATUS FOR THE IDLING RPM OF AN INTERNAL COMBUSTION ENGINE

[75] Inventors: Harald Kalippke, Benningen; Richard Gerber, Stuttgart; Harald Sailer, Markgroeningen; Wolfgang Staudenmaier, Weinstadt, all of Fed. Rep. of Germany

[73] Assignee: Robert Bosch GmbH, Stuttgart, Fed. Rep. of Germany

[21] Appl. No.: 323,659

[22] Filed: Mar. 15, 1989

[30] Foreign Application Priority Data

Apr. 20, 1988 [DE] Fed. Rep. of Germany ... 8805211[U]

[51] Int. Cl.[4] ..... F02M 23/04; F02D 41/16

[52] U.S. Cl. ..... 123/339; 123/585; 251/129.11; 251/335.2

[58] Field of Search ..... 123/339, 585–589; 251/65, 129.11, 335.2

[56] References Cited

U.S. PATENT DOCUMENTS

| | | | |
|---|---|---|---|
| 4,388,913 | 6/1983 | Grimm et al. | 123/585 |
| 4,428,558 | 1/1984 | Odogaki et al. | 251/65 |
| 4,442,997 | 4/1984 | Idogaki et al. | 251/65 X |
| 4,494,517 | 1/1985 | Kratt et al. | 251/129.11 X |
| 4,724,349 | 2/1988 | Grimm et al. | 310/216 |

*Primary Examiner*—Tony M. Argenbright
*Attorney, Agent, or Firm*—Edwin E. Greigg

[57] ABSTRACT

An apparatus for assisting in governing the idling rpm of an internal engine including a bypass line that bypasses a throttle valve in an air intake tube. A rotary slide valve secured to one end of a shaft which is controlled by a motor is rotatable in the bypass line to adjust air flow through the bypass line. The bypass line is integral with a lid-shaped housing part in which roller bearings juxtaposed the rotary slide valve is secured. The upper end of the shaft is rotatable in bearings carried by an upper housing part. The housing parts are secured together in axial alignment with each other.

4 Claims, 1 Drawing Sheet

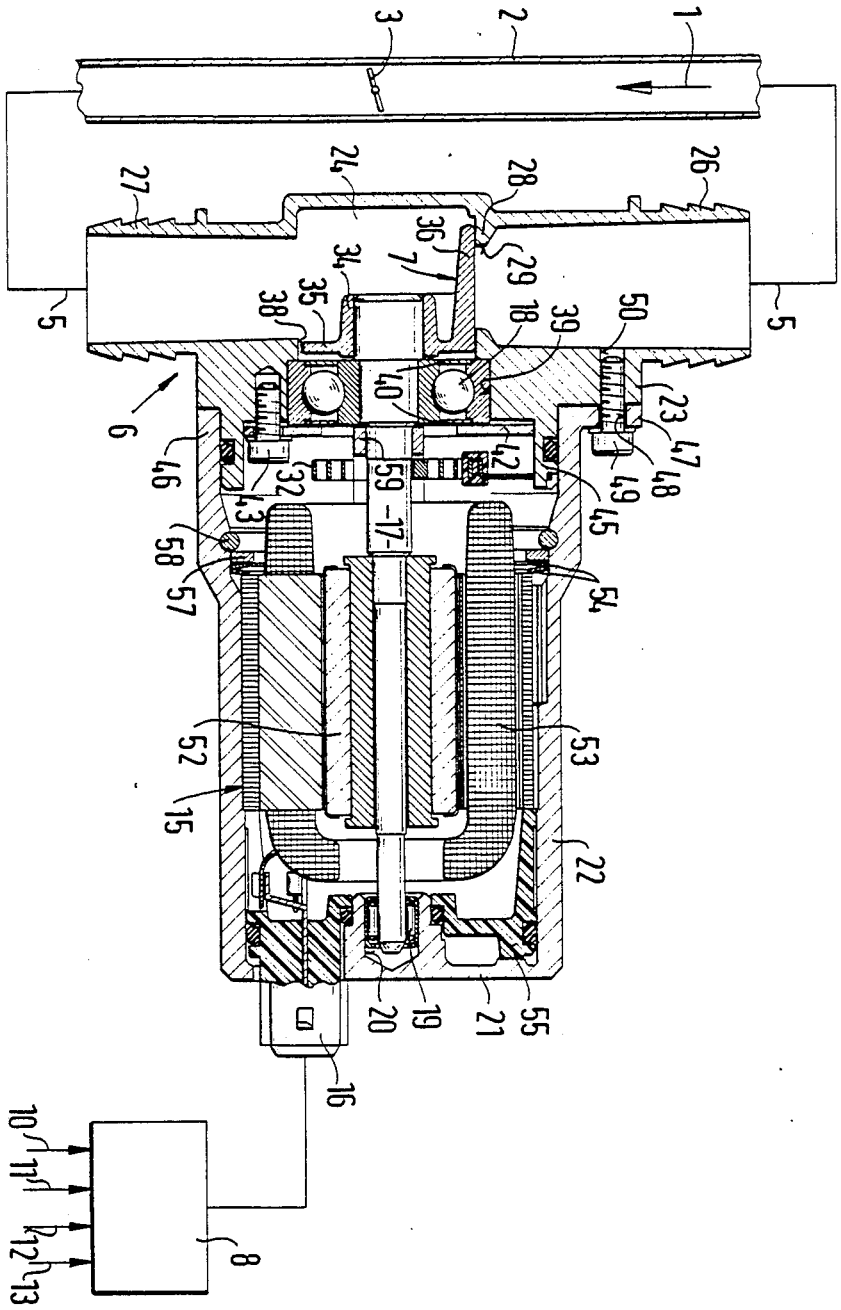
1
2
3
5
5
6
7
8
10
11
12
13
15
16
17
18
19
20
21
22
23
24
26
27
28
29
32
34
35
36
38
39
40
42
43
45
46
47
48
49
50
52
53
54
55
57
58
59

GOVERNING APPARATUS FOR THE IDLING RPM OF AN INTERNAL COMBUSTION ENGINE

BACKGROUND OF THE INVENTION

The invention is based on an apparatus for governing the idling rpm of an internal combustion engine of an internal combustion engine. Such an apparatus has been set forth in U.S. Pat. No. 4,724,349, in which a hollow shaft having a rotary armature and a rotary slide valve that controls the bypass line is supported on a stationary shaft that is retained in a connecting body disposed on one end in a lid-like housing part and on the other in a cup-shaped housing part. Because of the large tolerances required, this kind of support of the rotary slide valve necessitates relatively large play between the circumference of the rotary slide valve and the wall of the pivoting space into which the rotary slide valve protrudes; otherwise, the rotary slide valve, if it is not supported 100% coaxially with the pivoting space, might scrape the wall of the pivoting space. Because of the pressure drop that prevails between atmospheric pressure and the negative pressure prevailing when the engine is running, air incorrectly flows via this undesirably large play between the circumference of the rotary slide valve and the wall of the pivoting space and undesirably impairs the governing process.

OBJECT AND SUMMARY OF THE INVENTION

The apparatus according to the invention has the advantage over the prior art of providing more precise support of the rotary slide valve, which makes it possible to reduce the tolerances of the rotary slide valve and pivoting space, which in turn results in less play and thus less incorrect air, and finally improves the accuracy of the idling rpm governing process. At the same time the relatively tight separation of the control motor from the pivoting space prevents a further exchange of air between the pivoting space and the interior of the control motor, which would also affect the governing accuracy and would soil the control motor.

It is particularly advantageous to join the two housing parts with a screw connection; as a result, the precise guidance between the two parts, and hence the coaxial support of the rotary slide valve with respect to the pivoting space are maintained during installation.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows an exemplary embodiment of the invention in simplified fashion.

DESCRIPTION OF THE PREFERRED EMBODIMENT

In the apparatus shown in the drawing for governing the idling rpm of an internal combustion engine, combustion air flows in the direction of the arrow 1 through an air intake tube 2, past a throttle valve 3 serving as a throttle device, to the engine, not shown. Communicating with the air intake tube 2 is a bypass line 5 which bypasses the throttle valve 3; the flow cross section of the bypass line 5 is variable by means of the apparatus 6 by means of a throttle device embodied as a rotary slide valve 7. The apparatus 6 is triggered by an electronic control unit 8, to which a supply voltage furnished by a vehicle battery is applied at 10, an engine rpm signal picked up from the ignition distributor of the engine is applied at 11, an engine temperature signal is applied at 12, and a voltage representing the position of the throttle valve 3, furnished for instance by a potentiometer connected to the throttle valve, is applied at 13. Further engine operating characteristics may also be fed to the electronic control unit 8 as needed.

Serving as the control motor for the apparatus 6 in the present exemplary embodiment is a collectorless electric motor 15, which is triggerable by the electronic control unit 8 as a function of engine operating characteristics via a plug 16. In the excited state, the electric motor 15 rotates a shaft 17 which is rotatably supported via a first roller bearing 18 and a second roller bearing 19. The second roller bearing 19 is pressed into a blind bore 20 in the bottom 21 of a cup-shaped housing part 22 of the apparatus 6 On an end remote from the second roller bearing 19, the rotary slide valve 7, which is embodied as a tubular segment that protrudes into a pivoting space 24 embodied in a lid-shaped housing part 24 and intersecting the bypass line 5 is connected to the shaft 17 in a manner fixed against relative rotation with respect to the shaft 17. An inflow fitting 26 to the air intake tube 2 upstream of the throttle valve and a outflow fitting 27 to the air intake tube 2 downstream of the throttle valve communicate with the pivoting space 24. The circumference of the rotary slide valve 7 embodied as a tubular segment protrudes as close as possible to the wall of the pivoting space 24. In the wall 28 of the pivoting space 24 oriented toward the inflow fitting 26, at least one control opening 29 is recessed out; this opening can be opened to a variable extent by the rotary slide valve 7. The rotation of the rotary slide valve 7 by the electric motor 15 is effected counter to the force of a spring element, embodied for example as a spiral spring 32, which is connected at its inner end to the shaft 17 and at its outer end to the lid-shaped housing part 23. In the non-excited state of the electric motor 15, the spiral spring 32 turns the shaft 17 into a position in which the control opening 29 is not completely closed by the rotary slide valve 7, so that in this position a cross section sufficient for emergency operation remains open; by way of this cross section, air or a fuel-air mixture can flow through the bypass line into the air intake tube 2 from upstream to downstream of the throttle valve 3. In this operating state, the rotational position of the rotary slide valve 7 can be determined by an adjustable stop, not shown.

The rotary slide valve 7 serving as a throttle device is secured with a hub 34 to the shaft 17, from whence a transmission disk carrying a throttle element 35 extends radially embodied as a tubular segment, of the rotary slide valve 7 that opens the control opening 29 to a variable extent. A through bore 38 is formed in the lid-shaped housing part 23; the shaft 17 protrude all the way through the bore 38, and the throttle element 35 extends partway into the bore 38, both with as little radial play as possible with respect to the wall of the through bore 38. Remote from the pivoting space 24, the through bore 38 is adjoined by a bearing bore 39 of larger diameter, into which the first roller bearing 18 is pressed. In a known manner, the first roller bearing 18 has covering disks 40 that cover the roller bodies, so that virtually no exchange of media takes place via the first roller bearing 18 in the axial direction, between the side of the first roller bearing 18 oriented toward the rotary slide valve 7 and the side oriented toward the electric motor 15. Remote from the rotary slide valve 7, the first roller bearing 18 is engaged by a retaining disk 42 which protrudes partway past the first roller bearing 18 and is fixable in the lid-shaped housing part 23 by means of threaded screws 43 so that the retaining disk 42 braces the first roller bearing 18 in the axial direction The lid-shaped housing part 23 has an axially extending cylindrical guide section 45, upon which the open tubular end 46 of the cup-shaped housing part 22 is slipped tightly with little play; this housing part 22 for instance has radial steps 47 having axial bores 48, through which the retaining screws 49 protrude; on their other end, these screws 49 engage threaded bores 50 in the lid-shaped housing part 23 and assure a firm connection between the cup-shaped housing part 22 and the lid-shaped housing part 23. The connection of the two housing parts 22, 23 may also be accomplished in some other manner, however.

A rotary armature 52 is also secured to the shaft 17, located inside a winding 53 of the electric motor 53. The winding 53 is supported inside the cup-shaped housing part 22 and is pressed in the axial direction by plate springs 54 against a support body 55 resting on the housing bottom 21; the support body 55, made of plastic, also encompasses the plug 16, which protrudes in a sealed manner from the housing bottom 21. Inside the cup-shaped housing part 22, the plate springs 54 are supported via a shim 57 on a split clamping ring 58, which rests in an indentation in the cup-shaped housing part.

The installation of the apparatus is effected by first pressing the rotary slide valve 7 onto the shaft 17 and then superfinishing its jacket face. Next, the first roller bearing 18, a spacer bushing 59 retaining the inner end of the spiral spring 32, and the rotary armature 52 are pressed onto the shaft 17. Now the first roller bearing 18, with the elements secured to the shaft 17, is introduced into the bearing bore 39, and after adjustment of the spiral spring 32 is fixed in its position by means of the retaining disk 42. The second roller bearing 19, the support body 55, the winding 53, the plate spring 54, the shim 57 and the clamping ring 58 are installed in the cup-shaped housing part 22. After that, the two housing parts 22, 23 are united and firmly connected to one another by means of the screws 49. The embodiment of the apparatus 6 according to the invention makes it possible to have the smallest possible tolerances of the various elements of the apparatus so that the rotary slide valve 7 faces the wall of the pivoting space 24 with very little play, and leakage at the rotary slide valve is kept very slight. Uniting the two housing parts 22, 23 entails no risk of undefined shifting at the rotary slide valve 7. The minimally slight radial play between the circumference of the transmission disk 35 and the through bore 38, along with the covering disks 40 on the first roller bearing 18, also prevent an exchange of air between the interior of the electric motor and the bypass line 5, and hence prevents soiling of the control motor.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus for assisting governing the idling rpm of an internal combustion engine, having a control motor including a rotary armature which is connected to a shaft a rotary slide valve connected to one end of said shaft, said rotary slide valve controls a cross section of a bypass line around a throttle device disposed in an air intake tube of the engine, a housing embodied by a cup-shaped housing part and a lid-shaped housing part, said lid-shaped housing part is formed as an integral part of the bypass line that includes the cross section which is to be controlled by said rotary slide valve and which is penetrated by said rotar slide valve, said control motor includes at least one winding disposed in the cup-shaped housing part which is excited to rotate said armature and therewith said rotary slide valve, a first roller bearing (18), connected to the shaft (17) juxtaposed said rotary slide valve (7) and having roller bodies covering disks (40) covering opposite ends of said roller bodies, said first roller bearing being supported in a bearing bore in the lid-shaped housing part (23), and a second roller bearing (19) supported on said shaft (17) in a housing bottom (21) of the cup-shaped housing part (22).

2. An apparatus as defined by claim 1, in which said first roller bearing (18) is fixed in said lid-shaped housing in an axial direction by means of a shoulder on one end and a retaining disk (42) that protrudes past a end portion of said first roller bearing (18) and said retaining disk is secured by means of screws (43) to said lid-shaped housing part (23).

3. An apparatus as defined by claim 1, in which said two housing parts (22, 23) are connected to one another in axial relationship.

4. An apparatus as defined by claim 2, in which said two housing parts (22 23) are connected to one another in axial relationship.

* * * * *